US006968065B1

(12) United States Patent
Gu

(10) Patent No.: US 6,968,065 B1
(45) Date of Patent: Nov. 22, 2005

(54) MULTIPLE FUNCTION, BI-DIRECTIONAL INPUT/OUTPUT INTERFACE FOR SOUND PROCESSING SYSTEM

(75) Inventor: Jing-Lu Gu, Milpitas, CA (US)

(73) Assignee: SanDisk Corporation, Sunnyvale, CA (US)

( * ) Notice: Subject to any disclaimer, the term of this patent is extended or adjusted under 35 U.S.C. 154(b) by 0 days.

(21) Appl. No.: 08/936,559

(22) Filed: Sep. 24, 1997

(51) Int. Cl.[7] ..... H04R 3/00; H04R 29/00
(52) U.S. Cl. ..... 381/111; 381/59
(58) Field of Search ..... 381/120, 401; 400/88; 455/558; 701/94

(56) References Cited

U.S. PATENT DOCUMENTS

| | | | | |
|---|---|---|---|---|
| 3,979,566 A | * | 9/1976 | Willy | 381/401 |
| 4,554,411 A | * | 11/1985 | Armstrong | 379/102.06 |
| 4,677,657 A | * | 6/1987 | Nagata et al. | 455/558 |
| 5,483,577 A | * | 1/1996 | Gulick | 379/88.07 |
| 5,526,408 A | * | 6/1996 | Yekutiely | 379/90.01 |
| 5,531,600 A | * | 7/1996 | Baer et al. | 434/317 |
| 5,593,236 A | * | 1/1997 | Bobry | 400/88 |
| 5,595,445 A | * | 1/1997 | Bobry | 400/88 |
| 5,634,730 A | * | 6/1997 | Bobry | 400/88 |
| 5,812,561 A | * | 9/1998 | Giles et al. | 371/22.31 |

OTHER PUBLICATIONS

Dallas Semiconductor, "DS2434 Battery Identification Chip", pp. 1-20, Jul. 1997.*

* cited by examiner

*Primary Examiner*—Laura A. Grier
(74) *Attorney, Agent, or Firm*—Parsons Hsue & de Runtz LLP

(57) ABSTRACT

A multifunction analog input/output interface for a sound processing system reduces the number of I/O pins and system components by using a speaker as an output device, an input device, and/or a control device. The system includes an integrated circuit containing a multifunction pin for connection to the speaker, an output circuit that drives the speaker, and an input circuit that receives a signal from the speaker when sound or touching the speaker moves a magnet in the speaker. An activation circuit coupled to the multifunction pin, activates an operation of the integrated circuit when the speaker provides a signal above a threshold level. Thus, a single pin serves three functions, sound signal input, sound signal output, and operation activation. The operation activated can be, for example, a playback or record operation. A delay element in the activation circuit prevents reactivation of an operation until vibrations in the speaker from a completed operation have died away. One embodiment of the invention provides an integrated circuit having only three I/O pins but capable of playing back a sound signal recorded in the integrated circuit.

20 Claims, 7 Drawing Sheets

MULTIPLE FUNCTION, BI-DIRECTIONAL INPUT/OUTPUT INTERFACE FOR SOUND PROCESSING SYSTEM

BACKGROUND

1. Field of the Invention

This invention relates to sound processing systems and particularly to systems and circuits having a multifunction analog input/output interface for connection to a speaker that handles input, output, and activation functions.

2. Description of Related Art

Semiconductor memory systems for recording and playing back continuous analog signals such as sound signals require input and output interfaces for the analog signals. An input interface receives an input analog signal and converts the input signal into values that can be stored in the memory. An output interface converts values read from the memory back an output analog signal. FIG. 1 shows a block diagram of a semiconductor memory system 100 for recording and playing sounds. System 100 includes a memory array 140 which stores values received from an input interface including a microphone 120, an input amplifier 122, a converter 124, and write circuitry 126. During recording, microphone 120 picks up sounds and generates an analog input signal representing the sounds. Amplifier 122 amplifies the input analog signal. Typically, the maximum level of the input analog signal depends on the sound level at microphone 120, and amplifier 122 includes an automatic gain control (AGC) or automatic level control (ALC) circuit that adjusts amplifier 122 to amplify the input signal to an appropriate level for converter 124. Converter 124 converts the amplified input signal to values that write circuitry 126 stores in memory array 140. The type of converter 124 employed in the input interface depends on memory array 140. For example, if memory array 140 is a digital memory storing one or more bit of information per memory cell, converter 124 samples the level of the amplified input signal to generate a series of samples and converts each sample into a digital value indicating the level of the sample. Write circuitry 126 then writes a series of digital values to memory array 140. Alternatively, if memory array 140 stores analog values in memory cells, converter 124 samples the amplified input signal, and write circuitry 126 writes analog samples from converter 124 in memory array 140.

An analog output interface, which includes read circuitry 136, a converter 134, an output amplifier 132, and a speaker 130, converts the values stored in memory array 140 back into audible sounds. In particular, read circuitry 136 reads a series of sample values (analog or digital values depending on the type of memory array 140), and converter 134 converts the series into a continuous analog signal. Output amplifier 132 amplifies the analog signal from converter 134 to a level appropriate for driving speaker 130. Speaker 130 produces the sound.

Record and playback systems such as memory system 100 have many applications, and in some applications, low system costs are critical to making the systems practical. To reduce cost, memory circuit 110 may be fabricated as an integrated circuit formed on a single die. Such integration of circuits reduces the number of system components which tends to reduce system cost. However, system components such as microphone 120 and speaker 130 are not currently available or practical in forms that are integrable in an integrated circuit. Accordingly, memory circuit 110 needs input/output circuitry and pins for connection to microphone 120 and speaker 130. The needs of the input/output interface thus restrict the pin count and circuit size and can affect system costs. To provide a lower cost system than is currently available, systems and methods for reducing the number of system component and/or integrated circuit pin counts are sought.

SUMMARY

Embodiments of the invention provide a multifunction analog input/output interface with low pin count and fewer system components through the use of a speaker as both an output device (speaker) and as an input device (microphone). In particular, output circuitry drives the speaker in a conventional manner for sound output; and for sound input, sounds oscillate a speaker's diaphragm and magnet which induces an analog signal from the speaker that input circuitry amplifies. The number of system components for a record and playback system are thus reduced by eliminating the need for a separate microphone. Pin count is reduced since pins connected to the speaker are bi-directional to handle both input and output analog signals. Separate input pins for analog input signals and output pins for analog output signals are not required.

Another embodiment of the invention includes a system where an input signal from a speaker activates a system operation such as sound recording or playback. To activate the operation a user can touch the speaker or make a noise to cause the diaphragm to move. The movement of the speaker diaphragm generates an input signal that activates the system function, for example, by activating playback of a previously recorded signal. In the case of sound playback, a delay circuit disables reactivation of an operation until vibrations that a previous operation caused in the speaker have ceased. Using the interface for multiple functions in this manner further reduces pin count by eliminating a separate pin for controlling activation of the circuit's function. Additionally, the speaker serves multiple functions devices including the functions of a speaker, a microphone, and an activation switch in a conventional sound processing system.

In one embodiment, a playback system formed in an integrated circuit requires only three I/O pins, one for connection to a speaker, one for connection to a supply voltage, and one for connection to ground. This playback systen can be package in a simple and inexpensive three-pin packages such as a T092 package.

BRIEF DESCRIPTION OF THE DRAWINGS

Use of the same reference symbols in different figures indicates similar or identical items.

DETAILED DESCRIPTION OF THE PREFERRED EMBODIMENTS

In accordance with an aspect of the invention, an input/output (I/O) interface has bi-directional I/O pin connected to a speaker that is used for sound output and as a microphone for sound signal input. The interface eliminates the need for a separate microphone and therefore reduces the number of system components. Additionally, an integrated circuit in accordance with the invention has a low pin count because a bi-directional I/O pin replaces two pins, an input pin and an output pin, in a conventional analog interface. A further reduction in pin count and component count is achieved using the speaker and the bi-directional I/O pin for activation of system functions. For example, the speaker and bi-directional I/O pin can serve the function of a switch and start pin for initiating operations. Reductions in the number of system components and the number of I/O pins reduce system cost and complexity.

Figure 2:
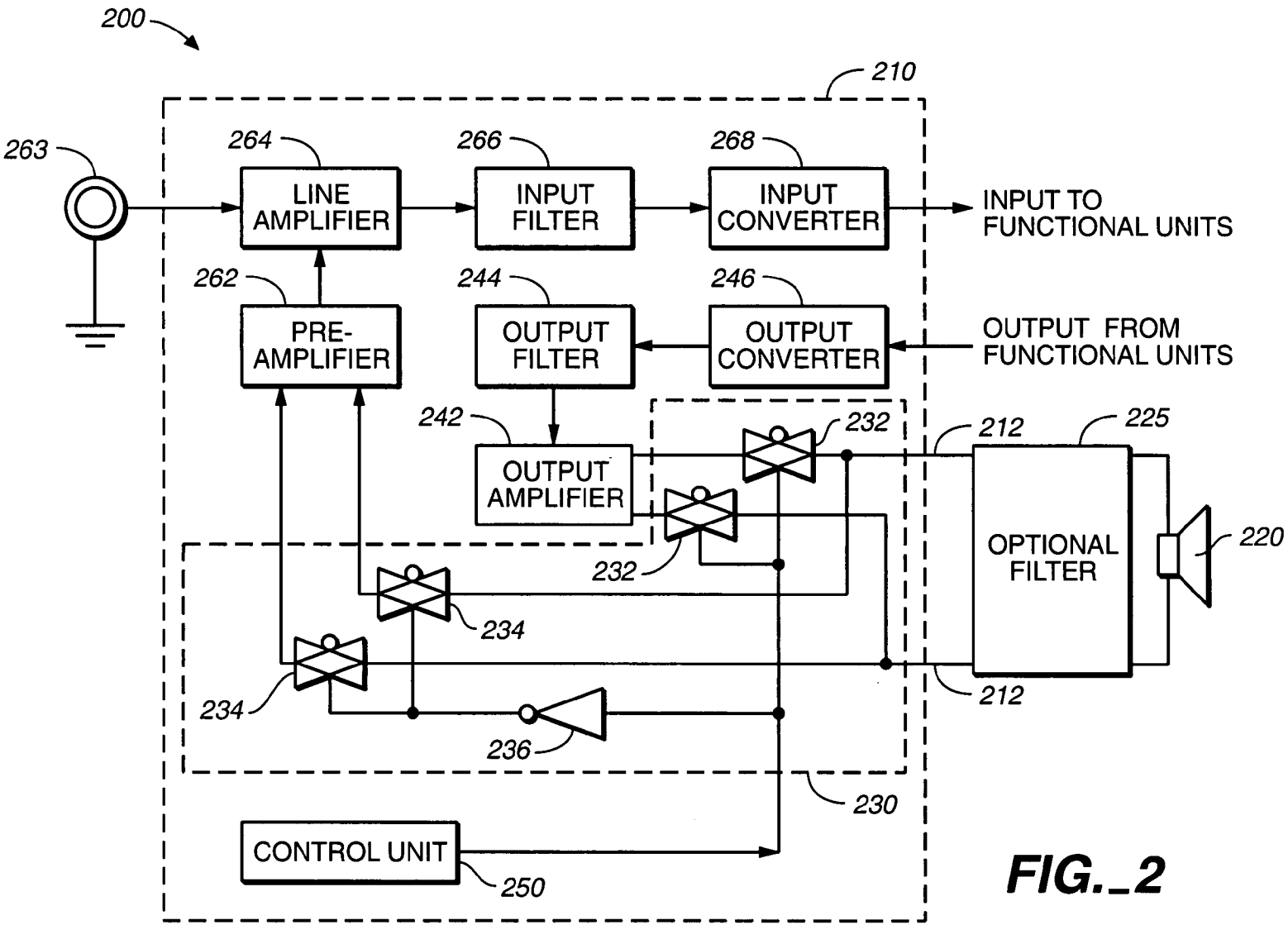
FIGS. 2, 3, and 4 show bi-directional analog input/output interfaces in accordance with alternative embodiments of the invention.

FIG. 2 shows a block diagram of a bi-directional analog input/output interface 200 in accordance with an embodiment of the invention. I/O interface 200 is suitable for systems that process an analog input signal representing sound and generate an analog output signal representing sound. An exemplary embodiment of a system using interface 200 is a record and playback system that records an analog sound signal in a semiconductor memory for subsequent playback. In the following, I/O interface 200 is described as applied in a record and playback system. However, I/O interface 200 is more generally applicable to other sound processing system such as a voice recognition system that analyzes an input voice signal and generates an output signal representing an audible reply.

Interface 200 includes a dual-purpose speaker 220 that is coupled to a bi-directional interface circuit 210 in an integrated circuit. Dual-purpose speaker 220 may be a conventional speaker that is designated "dual-purpose" for its use rather than structure. For a conventional speaker architecture, speaker 220 contains a magnet that is attached to a diaphragm and under the influence of a magnetic field from a coil. An analog signal from interface 200 to speaker 220 changes the current through the coil and the magnetic field applied to the magnet. The changing magnetic field, in turn, causes the magnet and the attached diaphragm to move or vibrate and produce a sound. Motion of the magnet relative to the coil changes the magnetic field applied to the coil and induces a voltage in the coil. Accordingly, when interface 200 is not applying a voltage to the coil in speaker 220, sounds that vibrate the diaphragm and magnet in speaker 220 create an analog voltage signal that the coil supplies as an input signal to interface 200.

The performance of speaker 220 in converting sound to an electrical signal is similar to a dynamic microphone. In particular, sound pickup for a speaker has a preferred direction according to the axis of the cone forming the diaphragm. The preferential direction provides automatic noise reduction if the speaker is pointed toward a sound source. Additionally, the speaker is better at generating a signal if the sound source is nearer speaker. This provides a further relative reduction in background noise. Accordingly, the speaker may have better noise rejection qualities than do conventional electrec microphones.

An analog filter 225 filters analog input and output signals passing between interface circuit 210 and speaker 222 and removes any DC biasing applied to speaker 220. Analog filter 225 is optional and may be omitted or provided as a separate system component or as an integrated part of interface circuit 210. When provided, analog filter 225 is preferably a bandpass filter that passes signals at audible frequencies within the range of speaker 220 but attenuates high frequency and DC signal components. Interface circuit 210 has a pair of I/O pins 212 for connection to speaker 220 via optional filter 225. Bi-directional filters having two "input" terminals and two "output" terminals are well known in the art.

In interface circuit 210, multiplexing circuitry 230 alternatively connects I/O pins 212 to output circuitry including an output converter 246, an output filter 244, and an amplifier 242 or input circuitry including a preamplifier 262, a line amplifier 264, an input filter 266, and an input converter 268. A control unit 250 generates a select signal for multiplexing circuitry 230 and determines whether to connect bi-directional pins 212 to input or output circuitry (i.e., to amplifier 262 or 242.) Control circuit 250 may include a user interface that selects whether the integrated circuit performs an input operation or an output operation. For the exemplary embodiment, an input operation is recording of a sound as a series of samples stored in a semiconductor memory, and an output operation is a playback which reads a series of samples from the memory and converts those samples to an audible sound. The user activates a button or switch to start a record (input) or playback (output) operation.

For an input operation, control unit 250 for the integrated circuit generates a select signal that turns on passgates 234 to connect I/O pins 212 to preamplifier 262 and turn off passgates 232 to disconnect I/O pins 212 from speaker amplifier 242. Accordingly, multiplexing circuitry 230 provides an analog input signal from speaker 220 as an input signal to preamplifier 262. Preamplifier 262 and line amplifier 264 amplify the input signal. The level of amplification required depends on the strength of the input signal from speaker 220 and the signal strength required by input converter 268 and functional units (not shown) connected to converter 268. Line amplifier 264 also has a direct input for a line signal 263 from a standard device such as a stereo or CD or tape player. Such line signals have a fixed maximum amplitude, and line amplifier 262 may include an automatic level control (ALC) or automatic gain control (AGC) circuit that adjusts to the level of line signal 263. An optional input filter 266 filters the amplified input signal to remove noise and digital or coding artifacts from the amplified signal and provides the amplified and filtered signal to input converter 268.

Figure 1:
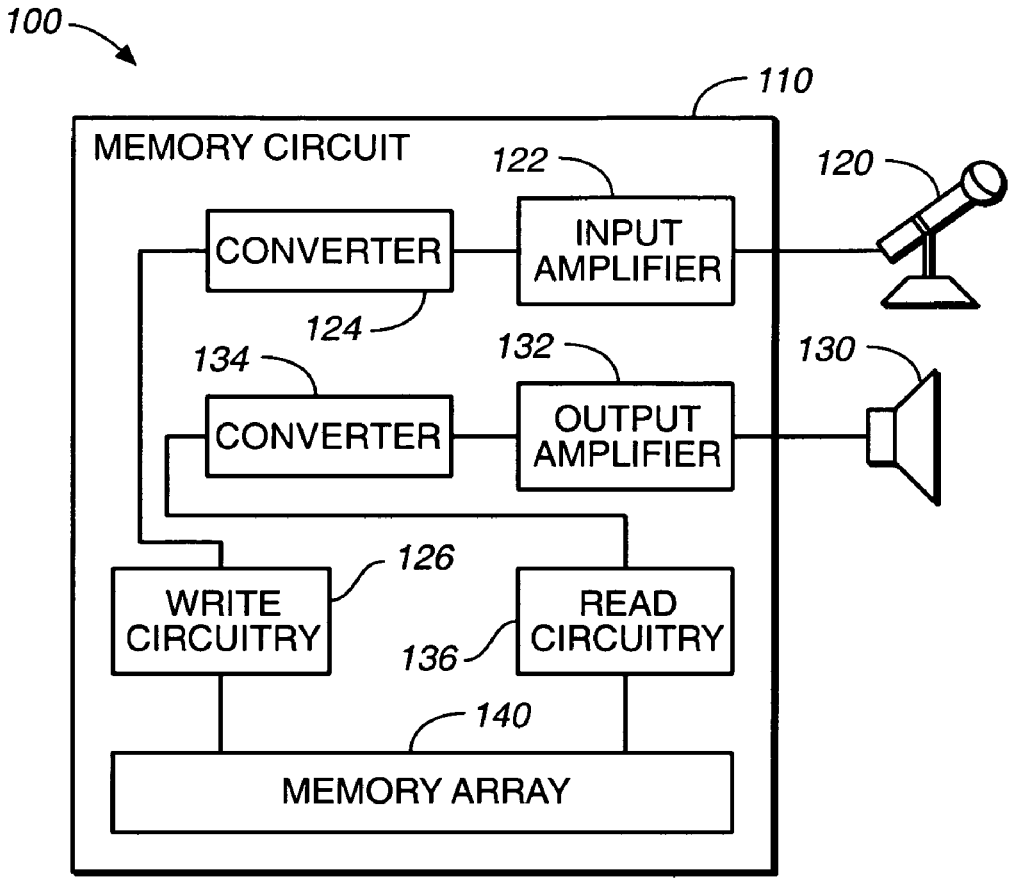
FIG. 1 (PRIOR ART)
FIG. 1 shows a prior art semiconductor memory system implementing sound recording and playback functions.

Input converter 268 converts the input signal as required by functional units that process the input audio signal. For example, input converter 268 may include a sampling circuit that periodically samples the level of the input signal to generate a discrete set of analog samples representing the continuous input signal. Input converter 268 may also include an analog-to-digital converter (ADC) that converts each analog sample to a digital value for processing by the functional units of the integrated circuit. In a record and playback system, the functional units receiving data from input converter 268 include a memory array and a write circuitry, and processing of the input signal includes writing samples from input converter 268 to the memory array. Conventional write circuitry and memory arrays for record and playback systems are described above in regard to FIG. 1.

For an output operation, control unit 250 generates a select signal that turns on passgates 232 to connect I/O pins 212 to amplifier 242 and turn off passgates 1234 to disconnect I/O pins 212 from amplifier 242. During the output operation, functional units in the integrated circuit generate output data for output converter 246. Output converter 246 converts the output data to a continuous analog signal and may include, for example, a digital-to-analog converter (DAC) that converts digital data to a continues analog signal. Output converter 246 may alternatively include a sample-and-hold circuit without a DAC in an embodiment having an analog memory that provides an analog signal when read during an output operation. An optional output filter 244, for example, a low pass or bandpass filter, can remove high frequency components of the analog signal and smooth the abrupt transitions that are common artifacts of digital processing. Speaker amplifier 242 amplifies the signal from filter 244 to a level appropriate for driving speaker 220, and multiplexing circuitry 230 provides the analog output signal from amplifier 242 to speaker 220.

Figure 3:
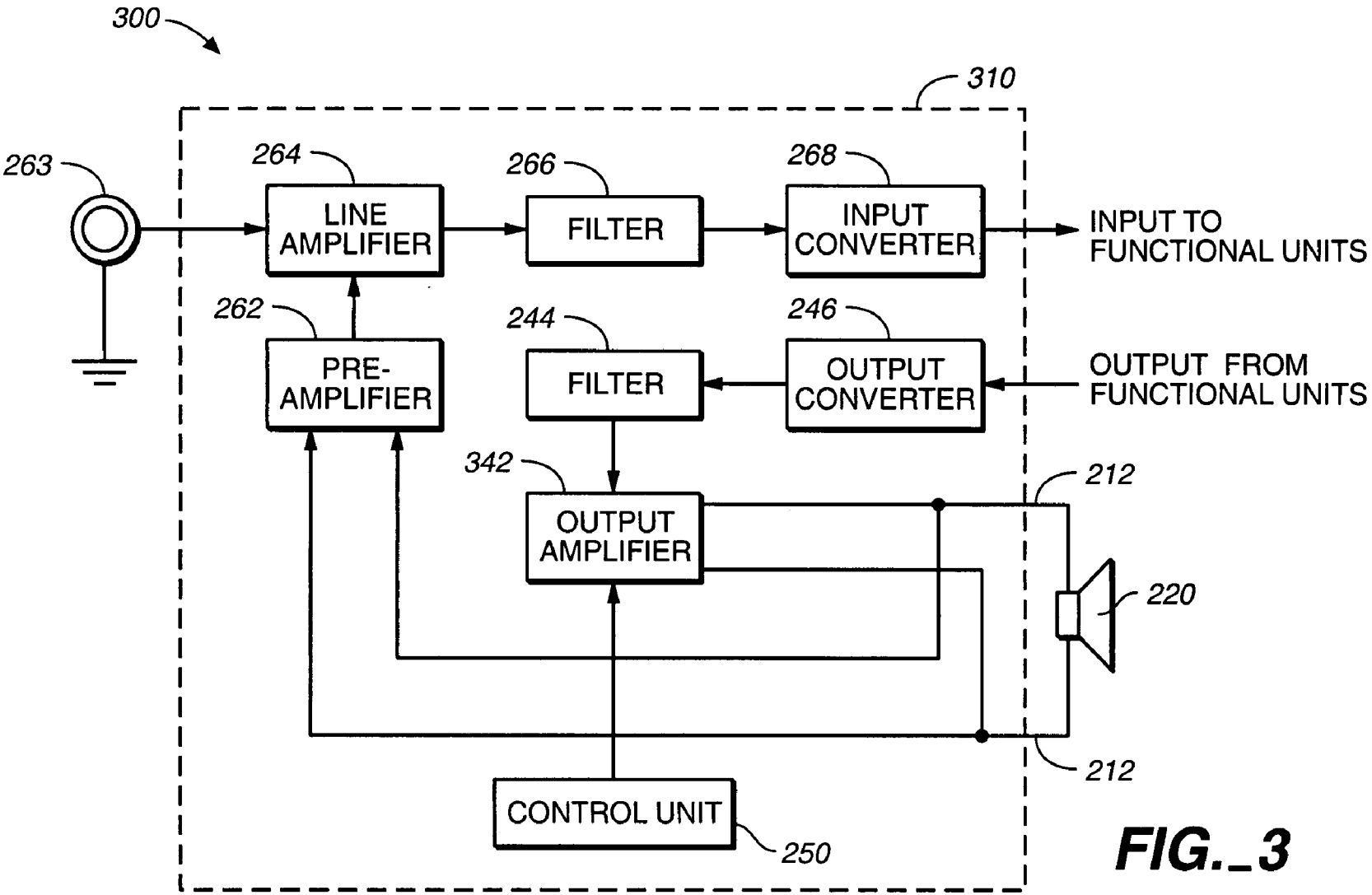

FIG. 3 shows a block diagram of a bi-directional analog I/O interface 300 according to another embodiment of the invention. Interface 300 contains many of the same circuit elements described above for interface 200 of FIG. 2. Interface 300 differs from interface 200 primarily in that interface 300 does not include multiplexing circuitry coupled to I/O pins 212. Instead, control unit 250 enables an output amplifier 342 and disables or puts amplifier 262 in a stand-by mode during an output operation. During the output operation, output amplifier 342 generates an analog output signal for driving speaker 220. Since I/O pins 212 are connected to both amplifiers 342 and 262, the output signal from amplifier 342 is also applied to the input terminals of amplifier 262. This does not present a problem because amplifiers such as amplifier 262 typically have high impedance and do not significantly alter a signal driving a low impedance device such as speaker 220. Additionally or alternatively to disabling amplifier 262, the functional units for processing input signals are disabled or put in a stand-by mode during an output operation so that the output signal from amplifier 342 is not misinterpreted as an input signal. During an input operation, control unit 250 disables amplifier 342 and enables amplifier 262. Disabled amplifier 342 has a high impedance and does not affect the input analog signal from speaker 220.

Figure 4:
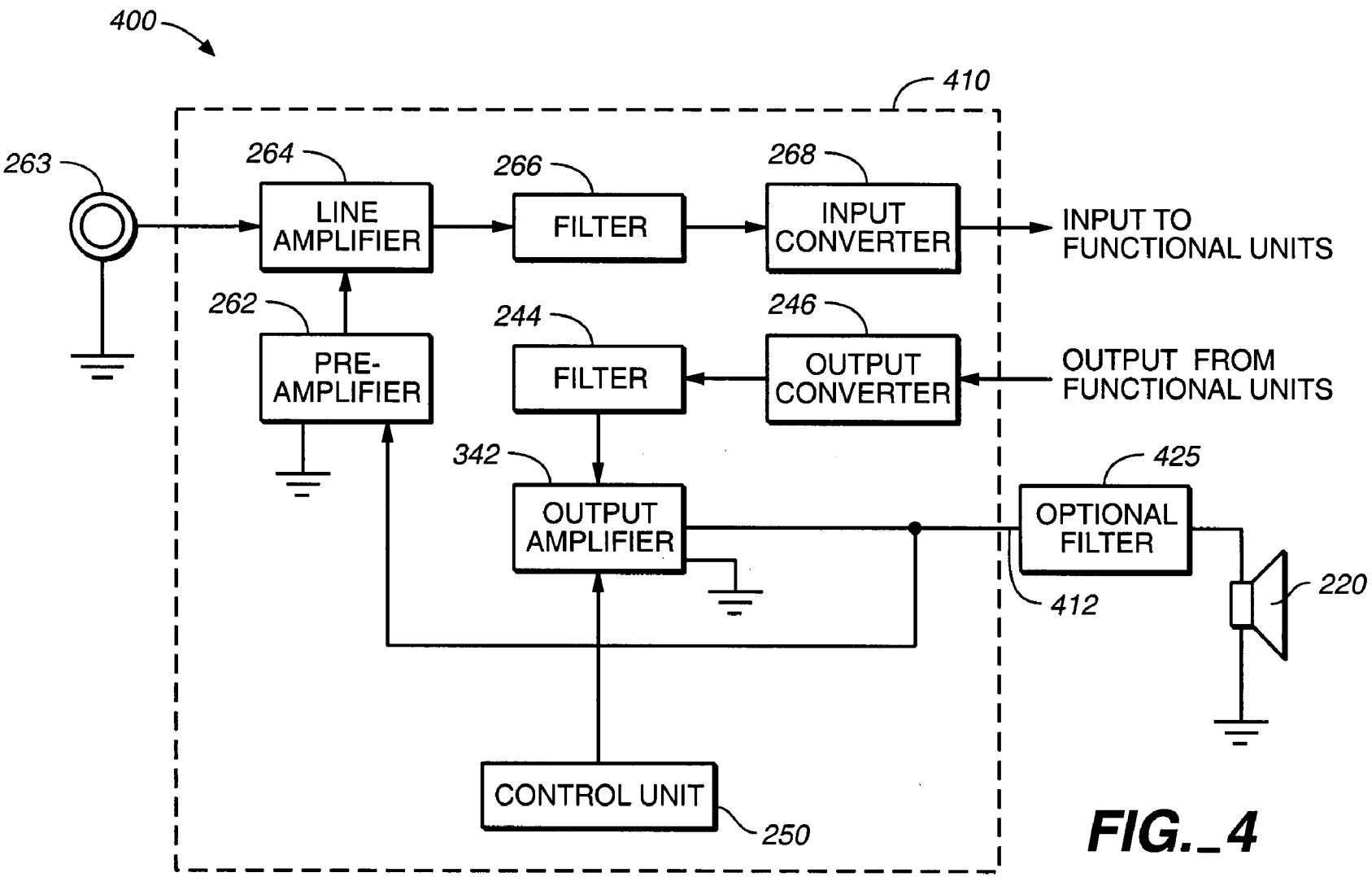

FIG. 4 shows a block diagram of a bi-directional analog I/O interface 400 in accordance with another embodiment of the invention. Interface 400 contains many of the same circuit elements described above for interfaces 200 and 300 of FIGS. 2 and 3. Interface 400 differs from interface 300 primarily in that interface 400 uses a common-ground for analog signals from speaker 220 and output amplifier 342. Interface 400 reduces pin count since only one bi-directional pin 412 is required for analog input and output. A ground terminal, which is conventionally required for integrated circuits anyway, is coupled to inputs terminals of amplifiers 262 and 342 and to one of the input terminals of speaker 220. Interface 400 may include an optional input/output filter 425 between speaker 220 and amplifiers 262 and 342 in interface circuit 410. Filter 425 can be, for example, a circuit element such as a capacitor having a single input terminal and a single output terminal.

Figure 5:
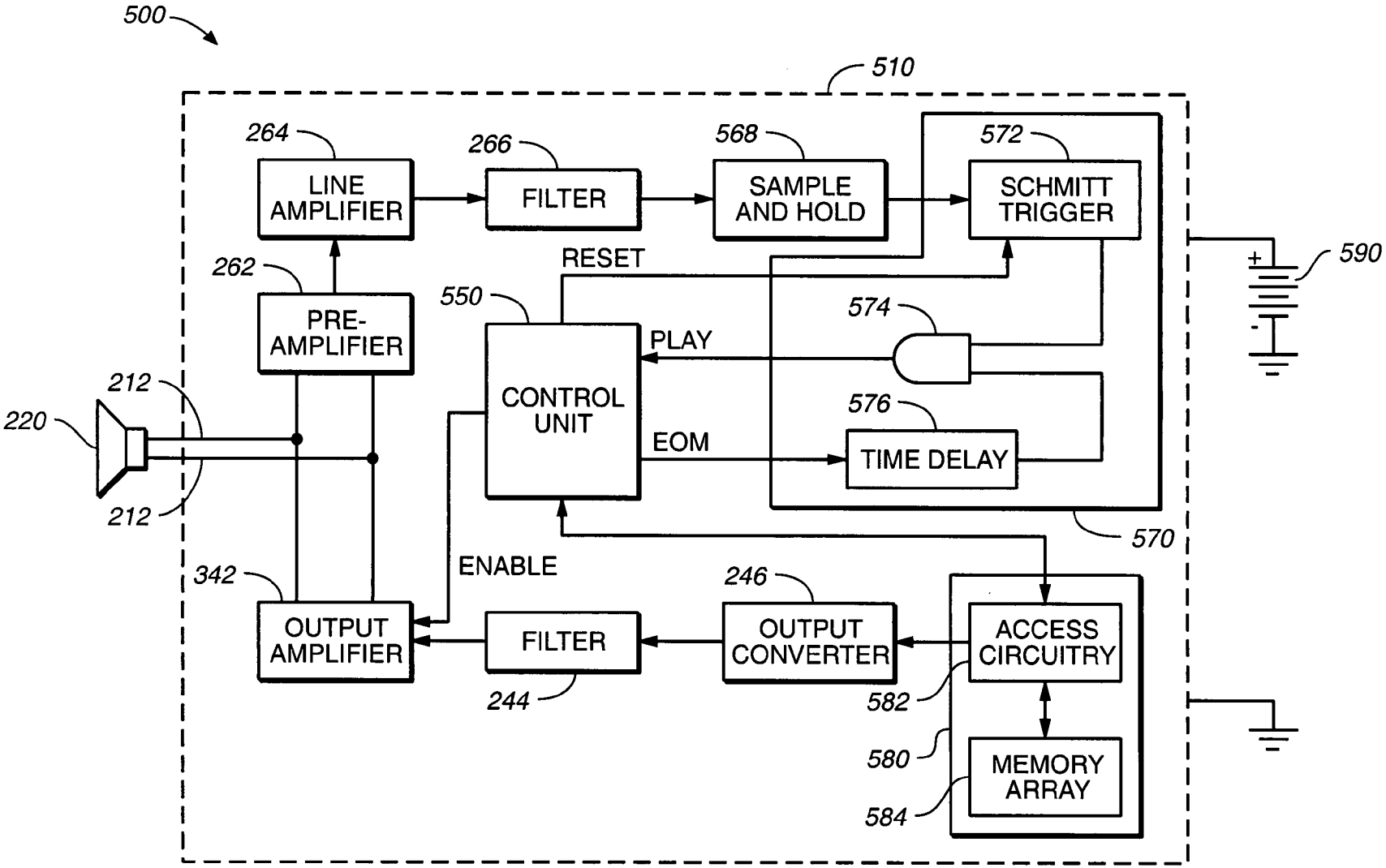
FIG. 5 shows a sound processing system in accordance with an embodiment of the invention where an input signal from a speaker activates the system.

FIG. 5 shows a block diagram of a system 500 using a single pin of an analog interface for up to three purposes, input of a signal being recorded, output of signal representing recorded audio that is being played, and activation of a record or playback operation. System 500 includes speaker 220 and an integrated circuit (IC) 510 that has two functional units 570 and 580. Functional unit 570 initiates a record or playback operation when an input signal from speaker 220 exceeds a threshold level. Functional unit 580 executes the record or playback operation once initiated.

In operation, system 500 is initially in a wait state where output amplifier 342 is disabled and functional unit 570 waits for an input signal indicating that an operation should be started. The operation to be started depends on the configuration of the system 500. In one embodiment, a switch or some other mechanism configures system 500 for either a record or a playback operation. Alternatively, functional unit 570 may only be capable of initiating one operation (e.g., playback). The following describes the example where system 500 is used only for playback operations. To start the playback operation, a user moves the magnet in speaker 220 enough to generate an input signal having magnitude greater than the threshold level. For example, a user can make a noise by talking, whistling, or clapping or a user can touch speaker 220 to start the diaphragm and magnet vibrating. A user can contact the diaphragm either directly or through some mechanism that moves the diaphragm or can touch another portion of the speaker. Touching the speaker without touching the diaphragm can generate a relatively large input signal because induced vibrations or noise from the touching is in close proximity to the diaphragm and magnet.

The input signal from speaker 220 is amplified by preamplifier 262 and line amplifier 264 before being filtered by input filter 266 and applied a sample-and-hold circuit 568 that acts as an input converter for functional unit 570. Circuit 568 periodically samples the level of the amplified input signal and provides the sampled level to a Schmitt trigger 572 that defines the threshold level for starting a playback operation. If the sampled level is greater than the threshold level, Schmitt trigger 572 asserts high a signal to a first input terminal of an AND gate 574. A delay element 576 asserts to a second input terminal of AND gate 574 a signal that is high except during a delay time immediately after the end of a playback operation as described below. Accordingly, if a playback operation has not just ended, AND gate 574 asserts a signal PLAY to a control unit 550 in response to Schmitt trigger 572 detecting a sampled level greater than the threshold level. In response to signal PLAY being asserted, control unit 550 starts a playback operation. In some embodiments, Schmitt trigger 572 can be located elsewhere in integrated circuit 510. For example, trigger 572 can be directly coupled to amplifier 264, amplifier 262, or terminals 212. Alternatively, trigger 572 can be eliminated if moving speaker 220 causes an input signal of sufficient amplitude to operate AND gate 574.

Functional unit 580 performs the playback operation and includes a memory array 584 that stores a series of values representing a recorded audio signal to be played. The audio signal may be recorded in memory array 584 using an on-chip or off-chip recording circuit or may be recorded during manufacture of IC 510. For the playback operation, control unit 550 in response to signal PLAY sends control signals to enable output amplifier 342 and start access circuitry 582 in functional unit 580. Access circuitry 582 reads the series of values representing the recorded audio signal and provides the series to output converter 246. Output converter 246 converts the series of values into an analog signal that filter 244 filters and supplies to output amplifier 342. Output amplifier, being enabled, generates an analog output signal that drives speaker 220.

When access circuit reaches the end of the recorded message, control unit 550 asserts a signal EOM to delay element 576. In response, delay element 576 deasserts the input signal to AND gate 574 for a delay time. During the delay time, AND gate 574 deasserts signal PLAY regardless of the level of the output signal from Schmitt trigger 572. This keeps Schmitt trigger 572 from incorrectly initiating another playback operation because of residual vibrations in the membrane of speaker 220 or voltage from output amplifier 342 that may remain after a playback operation ended. Delay element 576 keeps the input signal to AND gate 574 low for a time sufficient to allow such vibrations and stray voltages to die out. During the delay time, Schmitt trigger 572 is reset to await another sampling which provides a sampled level above the threshold level.

An advantage of system 500 is that speaker 220, which provides the audio output, is also used in an input interface for activating system 500. Accordingly, in an embodiment of the invention, additional system components such as buttons and switches that are connect for activating an operation are not required. Additionally, IC 510 does not require I/O pins for connection to such user interfaces. Accordingly, the cost of system 500 and IC 510 can be reduced.

Figure 6:
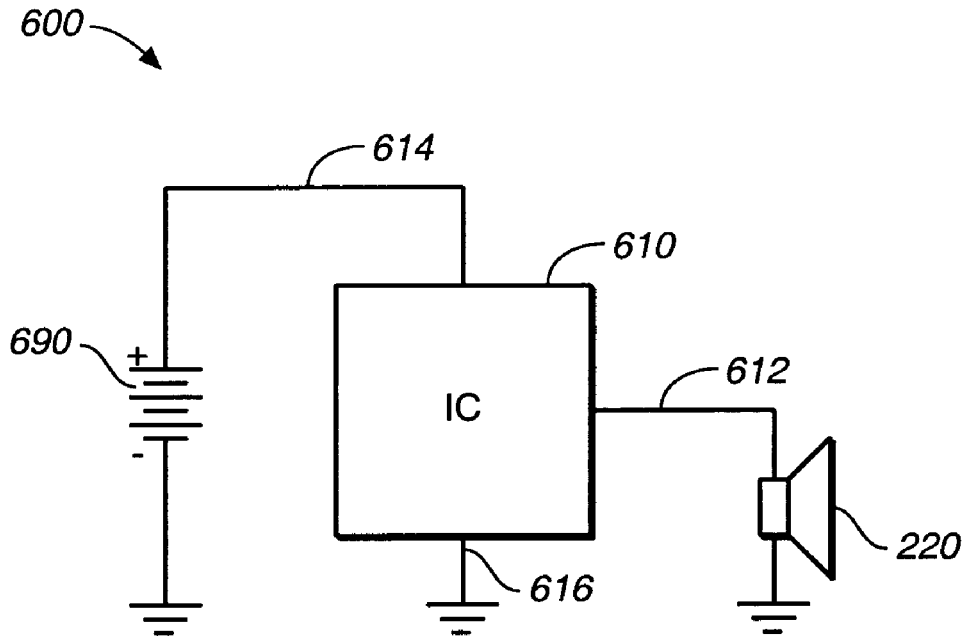
FIG. 6 illustrates a playback system having a minimum pin count.

FIG. 6 illustrates a playback system 600 having a common ground bi-directional interface. Playback system 600 includes an integrated circuit 610 having a bi-directional I/O terminal 612 connected to speaker 220, a power supply terminal 614 coupled to a power supply 590, and a ground terminal. Integrated circuit 610 contains the same structure as IC 510 of FIG. 5, but for system 600, each of speaker 220, amplifier 262, and amplifier 342 has one terminal connected to ground as illustrated in FIG. 3 and functional unit 580 is configured for playback operations only. System 600 is an inexpensive system for use where playback of prerecorded messages is desired. Applications of system 600 include, for example, generation of warning messages in automobiles and other devices, administration of greetings or informative messages, and general sound production. The three terminals 612, 614, and 616 provide a minimum pin count (3-pin) configuration for a playback system that can be user activated via an input signal from speaker 220. Integrated circuit 510 can be provided in an inexpensive three pin package such as a T092 package commonly used for transistors, if the die size of integrated circuit 510 is sufficiently small.

Figure 7:
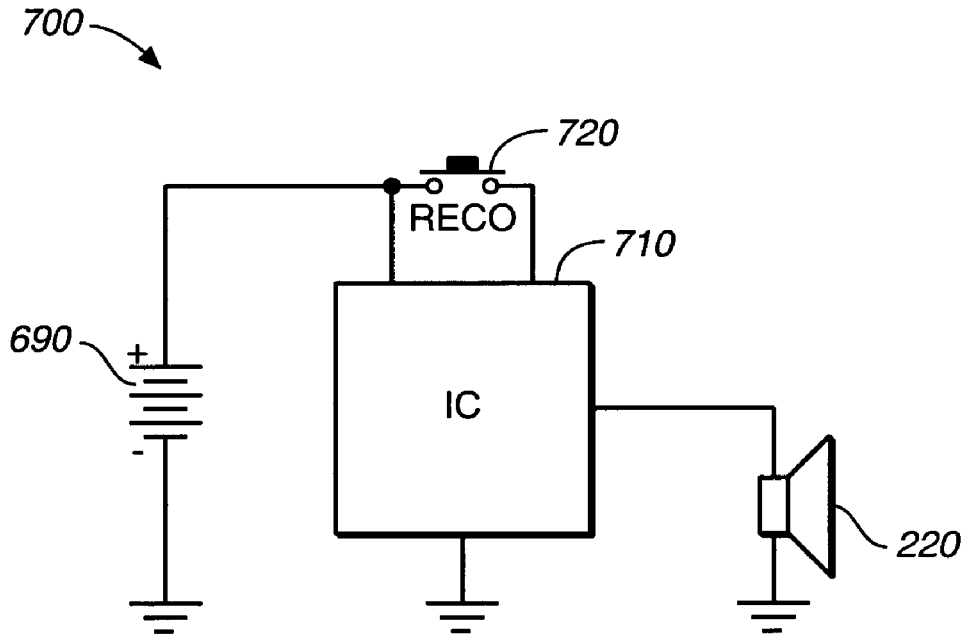
FIG. 7 illustrates a system configuration with record and playback functions.

FIG. 7 illustrates a system 700 implementing both record and playback operations. System 700 uses an integrated circuit 710 in a four pin package and further includes power supply 690, speaker 220, and a switch 720 for activation of record operations. In an exemplary embodiment of the invention, integrated circuit 710 contains the same structure as shown IC 510 of FIG. 5. When switch 720 is depressed, speaker 220 provides an input signal that is recorded in memory in IC 710. When switch 720 is not depressed, an input signal from speaker initiates playback of a recorded signal. In an alternative embodiment, the roles of the record and playback operations can be reverses so that switch 720 activates a playback operation, and a trigger signal from speaker 220 activates a record operation.

Figure 8:
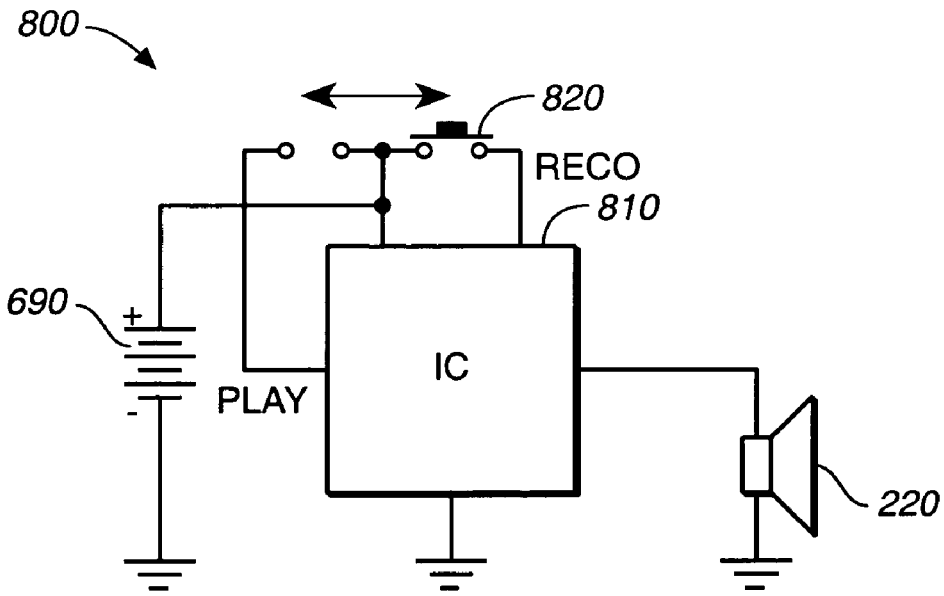
FIG. 8 illustrates a system configuration allowing user selection of whether a activation signal from a speaker activates a record or play operation.

FIG. 8 illustrates a record and playback system 800 having a user interface including a slide switch 820 connected to an integrated circuit 810. In an exemplary embodiment of the invention, integrated circuit 810 contains the same structure as shown IC 510 of FIG. 5. In operation, a user places system 800 in a record mode or a playback mode using switch 820 and then activate the record or playback operation by making a noise or touching speaker 220 to trigger functional unit 572.

The systems 600, 700, and 800 of FIGS. 6, 7, and 8 can be varied in a variety of ways. For example, any of systems 600, 700, or 800 can replace the single-pin interface to speaker 220 with a two-pin interface such as shown in FIGS. 2 and 3. Various switching arrangements are possible that allow a switch or a signal from speaker 220 to selectively activate either or both of the record and playback operations.

Figure 9:
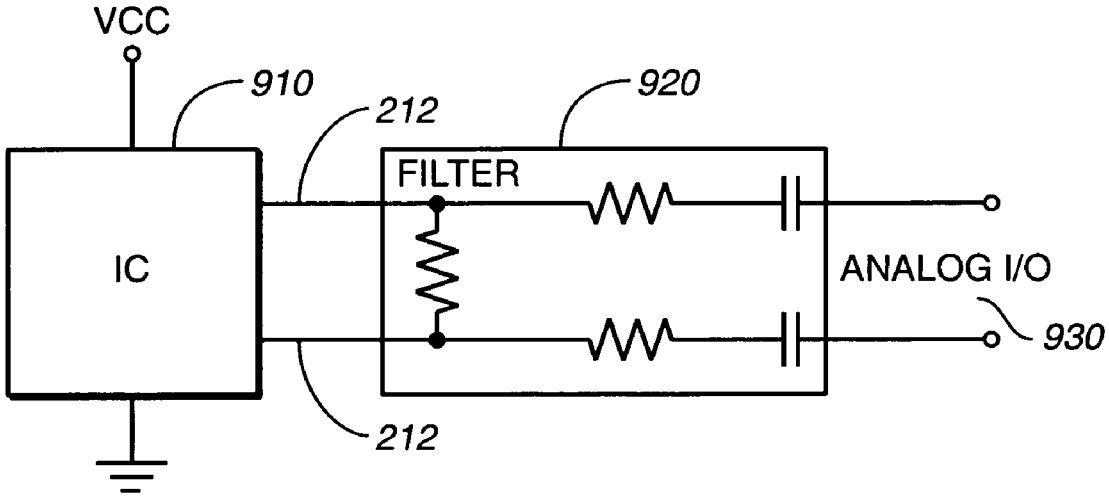
FIG. 9 illustrates an system in accordance with the invention having a multifunction input/output interface without a direct connection to a speaker.

As illustrated in FIG. 9, an integrated circuit 910 with multifunction input/output interfaces in accordance with the invention can also be used without a speaker. For example, integrated circuit 910 can connect to telephone lines 930 or another bi-directional source of analog signals. For a telephone connection, a filter 920 connected to terminals 212 of IC 910 limits the input voltage from telephone lines 930 to IC 910. IC 910 activates an input or record operation in response to an input signal on telephone lines 930 and generates an output signal as appropriate to functional units in IC 910.

Although the invention has been described with reference to particular embodiments, the description is only an example of the invention's application and should not be taken as a limitation. Various adaptations and combinations of features of the embodiments disclosed are within the scope of the invention as defined by the following claims.

I claim:

1. A sound processing system comprising:

a speaker;

an integrated circuit having a first terminal coupled to the speaker, the integrated circuit further comprising:

an output circuit coupled to the first terminal, wherein the output circuit applies to the first terminal an analog output signal to drive the speaker;

an input circuit coupled to the first terminal, wherein the input circuit processes an input signal from the speaker via the first terminal a functional unit; and an activation circuit that activates the functional unit in response to the input signal from the speaker exceeding a threshold level, wherein the functional unit is coupled to the output circuit and begins an output operation to drive the speaker in response to being activated by the activation circuit.

2. The system of claim 1, wherein:

the functional unit comprises a memory array and access circuitry capable of reading values from the memory array; and the output circuit comprises a converter coupled to the access circuitry, wherein the converter converts a series of values read by the access circuitry into an analog signal that determines the output signal.

3. The system of claim 2, wherein the input circuit comprises:

an amplifier coupled to the first terminal;

a second converter coupled to the amplifier and the access circuitry, wherein the second converter converts the input signal from the speaker into a series of values read that the access circuitry writes to the memory array.

4. The system of claim 3, wherein the output signal is derived from said series of values.

5. The system of claim 1, wherein the activation circuit includes a delay element coupled to prevent activation of the functional unit during a period following completion of an operation of the functional unit.

6. A sound processing system comprising:

a speaker;

an integrated circuit having a first terminal coupled to the speaker, the integrated circuit further comprising:

an output circuit coupled to the first terminal, wherein the output circuit applies to the first terminal an analog output signal to drive the speaker; and an input circuit coupled to the first terminal, wherein the input circuit processes an input signal from the speaker via the first terminal, a functional unit; and an activation circuit that activates the functional unit in response to the input signal from the speaker exceeding a threshold level, wherein the functional unit is coupled to the output circuit and begins an output operation to drive the speaker in response to being activated by the activation circuit, wherein the integrated circuit is in a three pin package including a first pin connected to the speaker and the first terminal of the integrated circuit, a second pin for connection to a power supply, and a third pin for connection to ground.

7. A sound processing system comprising:

a speaker;

an integrated circuit having a first terminal coupled to the speaker, the integrated circuit further comprising:

an output circuit coupled to the first terminal, wherein the output circuit applies to the first terminal an output signal to drive the speaker; and an input circuit coupled to the first terminal, wherein the input circuit processes an input signal from the speaker via the first terminal, a functional unit; and an activation circuit that activates the functional unit in response to the input signal from the speaker exceeding a threshold level, wherein the functional unit is coupled to the output circuit and begins an output operation to drive the speaker in response to being activated by the activation circuit, wherein the integrated circuit is in a three pin package including a first pin connected to the speaker and the first terminal of the integrated circuit, a second pin for connection to a power supply, and a third pin for connection to ground, and wherein the three pin package is a T092 package.

8. An integrated circuit comprising:

an input/output pin;

a sound processing circuit;

an output circuit coupled to the input/output pin, wherein the output circuit applies to the input/output pin an output signal representing a sound;

an activation circuit coupled to the input/output pin and the functional unit, wherein in response to an input signal from the input/output pin, the activation circuit activates the sound processing circuit;

an input circuit coupled to the input/output pin, wherein the input circuit, when active, transfers the input signal received from the input/output pin to the sound processing circuit; and a control circuit coupled to the sound processing circuit, wherein the control circuit selects an operation performed by the processing circuit when the activation circuit activates the sound processing circuit, and wherein the sound processing circuit comprises:

a first functional unit that performs an output operation to generate a signal to the output circuit and a second functional unit that performs an input operation to processes the input signal from the input circuit;

a memory array;

a read circuit coupled to the memory array, wherein the read circuit is part of the first functional unit and the output operation includes reading from the memory array a series of values representing a sound; and a write circuit coupled to the memory array, wherein the write circuit is part of the second functional unit and the input operation includes writing to the memory array a series of values representing the input signal.

9. The integrated circuit of claim 8, wherein the activation circuit comprises a delay element coupled to prevent the activation circuit from activating the sound processing circuit during a delay period following completion of an operation by the sound processing circuit.

10. The integrated circuit of claim 8, further comprising a die and a three-pin package in which the die is mounted, the three-pin package having exactly three pins including the input/output, a pin for connection to a power supply, and a pin for connection to ground.

11. The integrated circuit of claim 8, wherein the output signal is derived from said series of values.

12. A method for operating a sound processing system, comprising:

connecting a terminal of a sound processing circuit to a speaker;

creating a vibration in the speaker that causes the speaker to generate an input signal to the terminal of the sound processing circuit;

activating a functional unit in the sound processing circuit in response to the input signal; and in response to activating the functional unit, generating an analog output signal from the functional unit through the terminal to the speaker, wherein the output signal drives the speaker to produce a sound.

13. The method of claim 12, wherein creating the vibration comprises making a noise that causes a vibration in the speaker.

14. The method of claim 12, wherein the sound processing circuit is an integrated circuit and the terminal is a bidirection input/output pin of the integrated circuit.

15. The method of claim 12, wherein generating the output signal comprises performing an output operation, and the method further comprising disabling activation of the functional unit during a delay time following the completion of the output operation.

16. A method for operating a sound processing system, comprising:

connecting a terminal of a sound processing circuit to a speaker;

creating a vibration in the speaker that causes the speaker to generate an input signal to the terminal of the sound processing circuit, wherein creating the vibration comprises touching in the speaker;

activating a functional unit in the sound processing circuit in response to the input signal; and in response to activating the functional unit, generating an output signal from the functional unit through the terminal to the speaker, wherein the output signal drives the speaker to produce a sound.

17. A method for operating a sound processing system, comprising:

connecting a terminal of a sound processing circuit to a speaker;

creating a vibration in the speaker that causes the speaker to generate an input signal to the terminal of the sound processing circuit;

activating a functional unit in the sound processing circuit in response to the input signal; and in response to activating the functional unit, generating an output signal from the functional unit through the terminal to the speaker, wherein the output signal drives the speaker to produce a sound; and recording an audio input by said functional unit through the speaker prior to creating the vibration, wherein the output signal is derived from the audio input.

18. An integrated circuit comprising:

an input/output pin;

a memory array;

a sound processing circuit including:

a write circuit coupled to the memory array and to the input/output pin, wherein the write circuit performs an input operation that includes writing to the memory array a series of values representing an audio signal received from the input/output pin; and a read circuit coupled to the memory array and to the input/output pin, wherein the read circuit performs an output operation that includes reading from the memory array and supplying to the input/output pin a series of values representing said audio signal; and an activation circuit coupled to the input/output pin and to the sound processing circuit, wherein the sound processing circuit is activated by the activation circuit to supply said audio signal to the input/output pin in response to an input signal received from the input/output pin.

19. The integrated circuit of claim 18, wherein said series of values are analog values.

20. The integrated circuit of claim 18, wherein said memory array comprises a FLASH EEPROM memory.

* * * * *